United States Patent [19]

Salazar

[11] 4,350,343

[45] Sep. 21, 1982

[54] SOCCER BOARD GAME

[76] Inventor: Jorge Salazar, 41-40 Union St., Flushing, N.Y. 11355

[21] Appl. No.: 211,185

[22] Filed: Nov. 28, 1980

[51] Int. Cl.[3] ..... A63F 3/00

[52] U.S. Cl. ..... 273/247

[58] Field of Search ..... 273/94, 247, 244, 85 R, 273/85 F

[56] References Cited

U.S. PATENT DOCUMENTS

| | | | |
|---|---|---|---|
| 1,611,174 | 12/1926 | Evers | 273/247 |

FOREIGN PATENT DOCUMENTS

| | | | |
|---|---|---|---|
| 2034079 | 12/1971 | Fed. Rep. of Germany | 273/247 |
| 297490 | 6/1932 | Italy | 273/247 |
| 526597 | 6/1940 | United Kingdom | 273/247 |
| 897085 | 10/1962 | United Kingdom | 273/247 |
| 1147095 | 2/1969 | United Kingdom | 273/247 |

*Primary Examiner*—Richard C. Pinkham
*Assistant Examiner*—Carl Moy
*Attorney, Agent, or Firm*—Berger & Palmer

[57] ABSTRACT

Game board apparatus and method for at least two players for simulating the play of soccer is disclosed. Game apparatus comprises two sets of playing pieces (22) representing two teams of soccer men, there being a plurality of forwards, a lesser plurality of defenders and a goalie on each team, the forwards on each team being distinguishable from each other as by indicia; a game board (28) having goal areas (36) at opposite ends of the board (28), each goal area (36) having indicia therein corresponding to the indicia on the forwards, and two sets of players' movement paths (46), one path for each forward on each team, each path including a first group of consecutive spaces (48,52) defining an advancing zone and a second group of consecutive spaces (50,52) defining an attacking zone, the defenders being positionable on the spaces in the paths occupied by the opposing team's forwards for blocking the movement of the forwards; a piece (24) representing a soccer ball, the soccer ball being movable with the forwards towards the goal areas (36); and chance means (26) manipulatable by the players for determining movement of the ball (24) among the forwards and into the goal areas (36), and for determining possession of the ball (24) between the two teams.

5 Claims, 9 Drawing Figures

SOCCER BOARD GAME

TECHNICAL FIELD

This invention pertains to board games, and more specifically to a board game for simulating, as nearly as possible, the actual play of the game of soccer.

BACKGROUND ART

Board games of all types are, of course, well known. However, applicant is unaware of any board game which accurately simulates the actual game of soccer, including all of the various plays involved therein.

DISCLOSURE OF INVENTION

The game apparatus according to the present invention comprises a game board, two teams of soccermen, chance means such as a die, and a piece representing a soccerball. Preferably, as in the actual game of soccer, there are twenty two soccermen, eleven on each team. In each team, there are preferably six forwards, four defenders, and a goalie. The forwards on each team are individually distinguishable, preferably by indicia imprinted thereon. For example, in the preferred embodiment of the game according to the invention, the six forwards on each team are distinguishable by numbers imprinted thereon.

The game board is preferably rectangular in shape with goal areas defined at opposite ends of the board. Six separate locations or spaces are defined in each goal area, and indicia corresponding to the indicia utilized for distinguishing the forwards on each team are associated with the spaces in each goal area. Twelve player movement paths are delineated on the board, six for each team. Six of the player movement paths extend along the board toward one goal area, the other six extending toward the other goal area. The player movement paths have a plurality of locations or spaces distributed therealong, which define the possible spaces for placement of the fowards and defenders. Preferably, each player movement path comprises two sections of consecutive spaces, a first section defining an advancing zone, and a second section defining an attacking zone, the latter preferably terminating adjacent the goal area. The die, or other chance means, is provided with indicia corresponding to the indicia distinguishing the forwards, which indicia are also associated with the six spaces in each of the goal areas.

At the beginning of play, each player preferably positions his six forwards on the first space of the advancing zone of each of his six player movement paths. The four defenders may be placed on any four spaces in the attacking zones of his opponent's player movement paths. The goalie may be placed on any one of the six spaces in the goal area being defended.

One of the players is selected as the player to attack, the other player being the defender. The attacking player then places the piece representing the soccer ball on one of his forwards, which are preferably provided with raised borders to retain the ball thereon. Desirably, placement of the soccer ball on one of the forwards is determined by rolling the die, whereupon the ball is placed on the forward whose number is indicated on the die. The attacking player's turn then begins. The attacking player preferably may move his forwards as follows on each turn. If a forward is in its corresponding advancing zone, the attacking player may move that forward as many spaces as he wishes along the advancing zone. If a forward is in its attacking zone, the forward may be advanced one space further, provided that the forward is not blocked by a defender. These moves only apply to the forwards without the ball. After moving the forwards without the ball, the attacking player then rolls his die and may either move the forward with the ball one space, or pass the ball to the forward whose number is indicated on the die. It is a preferred rule of play that if the forward receiving a pass is unblocked by a defender, that forward may advance two additional spaces, regardless of whether the receiving player is in its advancing zone or attacking zone. After rolling the die and either passing the ball or advancing the forward with the ball, the attacking players's turn ends. It is then the defending player's turn.

On each turn, the defending player moves by repositioning as many of his defenders as he chooses to other spaces in the attacking zones of his opponent's player movement paths. However, it is a preferred rule of play that a defender may not be moved from one attacking zone to another on two consecutive turns. After repositioning his defenders, the defending player rolls his die. If the number indicated on the die does not correspond to the forward carrying the ball, the defending player's turns ends, and the attacking player's next turn begins. However, if the number indicated on the die corresponds to the forward carrying the ball, one of two things occur. First, if the defending player has a defender directly blocking the advance of the forward with the ball when he rolls that forward's number, the defending player takes the ball away from the attacking player. In this situation, the defending player becomes the attacking player, and starts an attack. If, however, the defending player does not have a defender blocking the forward with the ball when he rolls the number of that forward, the defending player simply clears the ball. In this situation, the ball is preferably placed on one of the attacking player's defenders, whereupon the attacking player continues play with the next turn of his attack. However, when the attacking player rolls his die from this position, he does not have the option of advancing the forward with the ball, since the ball is now in the possession of a defender. Instead, he can only pass the ball.

Play continues in the above manner, with the players alternating turns, and with the possibility of the players exchanging roles as between the attacking player and the defending player. This preferably continues until the attacking player is able to position a forward with the ball on the final space of its corresponding attacking zone. Provided that space is unblocked by a defender, the attacking player is then permitted to kick the ball to the goal. To prevent the defending player from continuously repositioning his defenders in front of the attacking forward with the ball, it is a preferred rule of play that once a defending player is placed on the final space of an attacking zone, that defender may not thereafter be moved until the ball is actually kicked to the goal.

To kick the ball to the goal, the attacking player rolls his die, and places the ball on the space in the goal area bearing indicia corresponding to the number indicated on the die. If that space is occupied by the goalie, the defender has successfully defended the goal, whereupon he becomes the attacking player and commences an attack. If, on the other hand, the space is unoccupied by the goalie, it is a preferred rule of play that the defending player be given one last opportunity to defend his goal. Accordingly, the defending player then rolls his die, and is considered to have defended the goal if the number indicated on the die corresponds to the number in the goal area upon which the soccer ball has been placed. If the defending player does not roll that number, then a goal has been scored. When a goal has been scored, the players reposition their pieces to the spaces occupied at the start of play. Play then continues, with the player who was scored against preferably commencing the attack. When the ball is kicked to the goal but a goal is not scored, the attacking player's forwards are preferably returned to the ends of their corresponding attacking zones whereupon the defending player may reposition his defenders.

Play may continue until one of the player scores a predetermined number of goals, although preferably play continues for a predetermined period of time agreed to in advance among the players. For example, the players may agree to two thirty minute periods.

In addition to the rules of play described hereinabove, the game is preferably played according to a plurality of additional rules which further simulate the actual game of soccer. For example, rules are included which correspond to a header ball, penalty kick, corner kick, etc. These as well as further features of the preferred game according to the present invention will be more fully apparent from the following detailed description and annexed drawings of the presently preferred game apparatus and method.

BEST MODE FOR CARRYING OUT THE INVENTION

Figure 1:
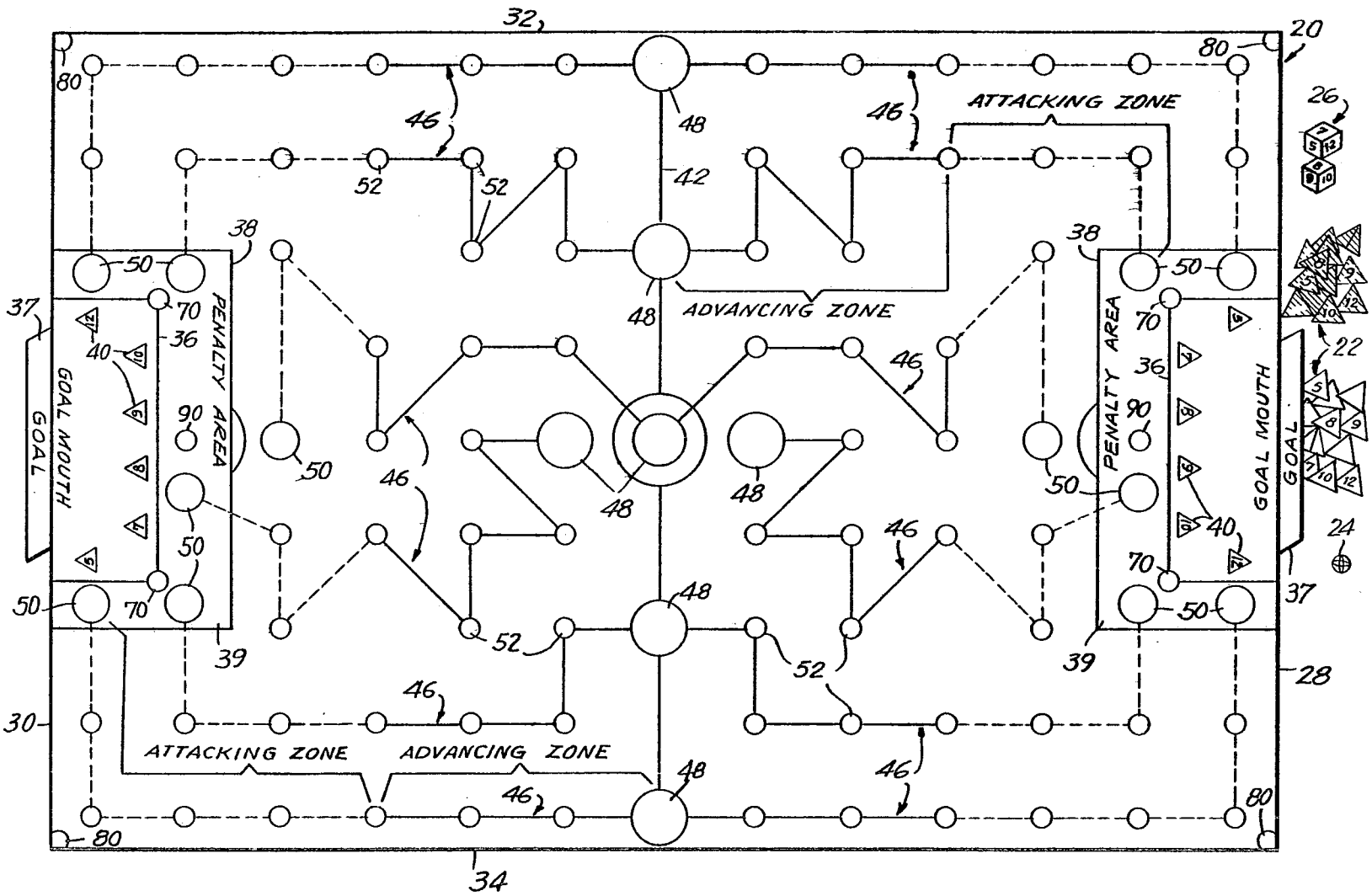
FIG. 1 is a top plan view of the preferred game apparatus according to the present invention.

Referring now to the drawings, and initially to FIG. 1 thereof, the components of the game apparatus according to the present invention are illustrated. As shown, the apparatus includes a game board 20, a plurality of preferably triangular playing pieces 22 representing the soccermen, a soccer ball 24, and chance means, shown here as dice 26. The board 20 is preferably of planar, rectangular construction comprised, for example, of cardboard or the like. Desirably, the board is provided with a centered fold line so that it may be folded in half for storage.

The board 20 depicts a soccer field, the perimeter of which is defined at its ends by the goal lines 28 and 30, and on its sides by the sidelines 32 and 34. At each end of the game board is a goal mouth defined by a rectangular area 36 and behind each goal mouth is a goal defined by a parallelogram 37. Each goal mouth is enclosed within a larger rectangular area 38 which generally defines the goal area. The spaces 39 between the goal mouths and the outer limits of their corresponding goal areas define the penalty areas. As shown, each goal mouth has a plurality, preferably six, of spaces 40 therein. The spaces 40 are preferably distinguishable by numbers imprinted therein, shown in the drawing as the numbers 5, 7, 8, 9, 10 and 12. As explained below, these spaces 40 represent the positions of the goalie as well as the trajectory of the ball 24 after it has been kicked to the goal.

Each half of the game board 20, i.e. from one side of the center line 42 to the corresponding goal line, has a plurality of lines 46, preferably six, extending therealong. As shown, each line 46 has a plurality of circles distributed therealong—a large circle 48 at the end of each line 46 nearest the center line 42, a medium size circle 50 at the end of each line 46 nearest the goal area, and a plurality of smaller circles 52 intermediate the circles 48 and 50. Preferably, five of the large spaces 48 are common to the lines 46 on both sides of the center line 42. Also, five of the medium size spaces 50 at each end of the board 20 are preferably disposed in the penalty area, the sixth space 50 at each end being outside the penalty area. As will be explained in detail below, the spaces 50 represent the "kick to the goal" positions from which the ball may be kicked to the goal.

As will be more fully explained below, the lines 46 define the lines of attack available to the soccermen 22 during play, and the spaces 48, 50, 52 define the possible positions of the soccermen and the ball 24 along the lines 46. Following the path from the large circular space 48 at one end of a line 46 to the medium size circular space 50 at the other end, the first group of spaces is connected by a solid line and the second group by a dotted or broken line. As is explained in greater detail below, the group of spaces connected by a solid line represents the "advancing zone", and the group connected by the dotted line represents the "attacking zone". As shown, a single space 52 represents the end of the advancing zone and the beginning of the attacking zone in each line of attack 46.

There are eleven playing pieces 22, or soccermen, on each team. The players on each team are preferably distinguishable by color. For example, the playing pieces 22 on one team may all be one color, such as blue, and the playing pieces on the other team another color, such as white. In the drawings, crosshatching is applied to one team of playing pieces 22 to distinguish them from the other team. The pieces on each team are broken down into three categories: six forwards, four defensemen and a goalie. The forwards are distinguishable by numerical indicia thereon which corresponds to the numerical indicia in the spaces 40 in the goal mouth. Thus, and as shown, each of the six forwards on each team bears one of the numbers 5, 7, 8, 9, 10 and 12. The reason for this will be apparent hereinafter. The defenders are preferably distinguishable from the forwards and the goalie by the fact that they do not bear any indicia. The goalie may be distinguishable from the other soccermen by any suitable indicia, such as the solid line shown in FIG. 1.

The soccer ball 24 may take any suitable shape, although it is preferably round and provided with suitable markings to simulate the appearance of an actual soccer ball. During most of the play, the ball is carried on the playing pieces 22, which preferably are provided with raised borders (not shown) to retain the ball 24 thereon.

The final elements of the game apparatus of the invention are the dice 26. The player controlling each team is provided with one die. Each die 26 has six faces, each having indicia thereon. The indicia on each die correspond to the indicia on the forwards and also to the indicia in the spaces 40 in the goal mouth. Thus, each die has one of the six numbers 5, 7, 8, 9, 10 or 12 on each of its six faces. As explained in greater detail below, the roll of the die determines the course of play. The player with the ball 24 rolls his die to "pass the ball" or "kick the ball to the goal". The defender rolls his die to "clear the ball" or "take the ball away" from the attacker. Certain rolls also initiate other plays such as "ball out of bounds", "corner kick", "penalty kick", etc. all as is more fully explained below.

Figure 2:
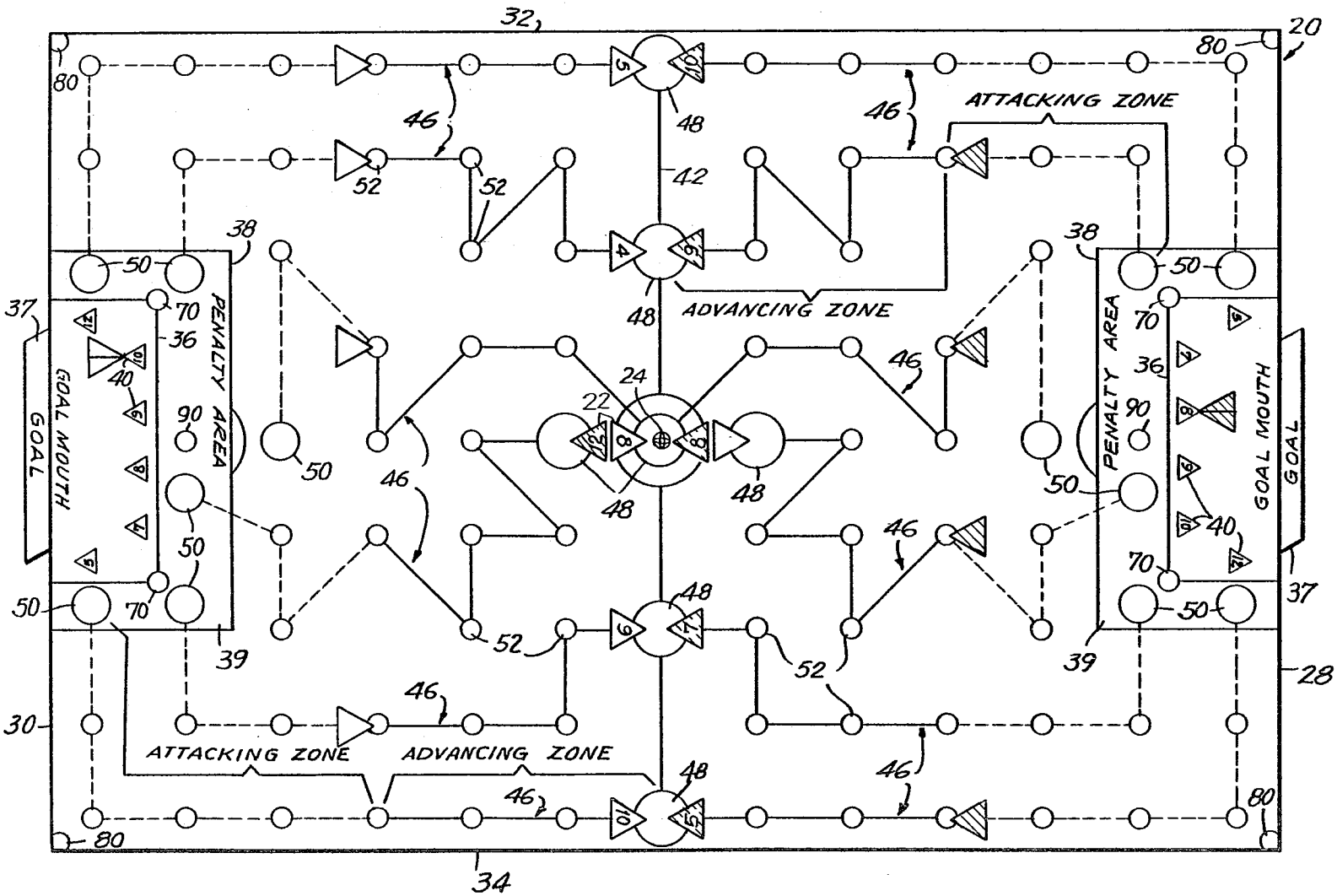
FIG. 2 is a view similar to FIG. 1, but showing the preferred position of the playing pieces at the commencement of play.

Referring to FIG. 2, the position typically occupied by the pieces 22 at the commencement of play and after a goal has been scored is shown. Thus, at the beginning of play, the ball 24 is placed on the center of the board 20, and each player positions his six forwards on the large spaces 48 at the beginning of each of his six lines of attack 46. While the numbered forwards may be arranged at random, the sequence shown in FIG. 2 is preferred. The four defenders may be positioned on any four of the spaces 52 at the beginning of the opposing player's attacking zones. Each player may position his goalie on any one of the spaces 40 in the goal mouth being defended. Preferably, only the noses of the pieces 22 are placed on the spaces 40, 48, 50 and 52, with the noses pointed in the direction of the goal being attacked.

Any suitable means may be used to determine which of the two teams will attack first. For example, a coin may be tossed. It will be assumed that the player controlling the crosshatched pieces 22 has won the toss and is to attack first. On the first move of the attack, the attacking player rolls his die and places the soccer ball 24 on the forward bearing the indicia indicated on the die. For example, if the attacking player rolls the number 7, the soccer ball is placed on the forward bering the number 7. The attacking player is next permitted to move any of his forwards which do not have the ball, i.e. the forwards 5, 8, 9, 10 and 12, as many spaces as desired along the advancing zones (solid line portions) of his lines of attack 46. Each forward is only permitted to move along its assigned line of attack 46. Thus, in FIG. 2, the attacking player could move any or all of the forwards, 5, 8, 9, 10 and 12 to the space 52 at the end of the advancing zone of its corresponding line of attack 46. This is so even though some of these spaces are also occupied by the opposing team's defenders. Thus, a forward and opposing defender may both occupy the same space simultaneously. When this occurs, the defender is considered to be blocking the advance of the forward. Except in the case of the exception noted below, it is not permitted for a forward to go around a defender who is blocking the advance of that forward.

Figure 3:
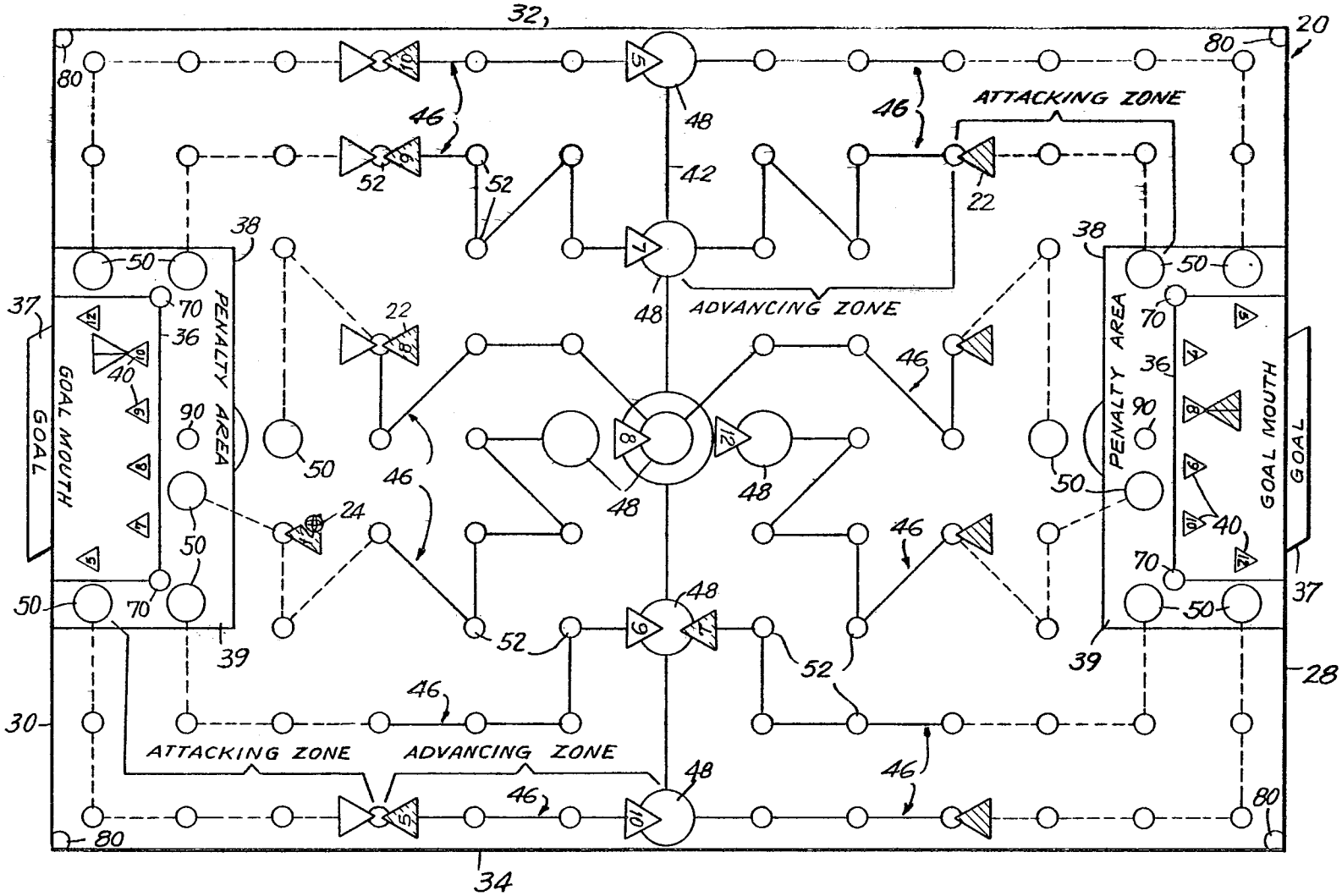
FIGS. 3–9 are all top plan views similar to FIG. 2 but showing various exemplary positions of the pieces during play.

Assuming that the attacking player elects to move each of the forwards 5, 8, 9, 10 and 12 to the last space in its corresponding advancing zone, the attacking forwards will then occupy the positions shown in FIG. 3, wherein it may be seen that the forwards 5, 8, 9 and 10 now confront the opposing player's defenders. At this point, the attacking player again rolls his die. Assuming the number indicated on the die is 12, the attacking layer has two options. He may either pass the soccer ball 24 to the forward whose number is indicated on the die, i.e. the forward 12, or advance the forward carrying the ball one space along its line of attack. Thus, the forward with the ball is never permitted to advance more than one space at a time, regardless of whether that forward is in its advancing zone or attacking zone. If the player elects to pass the ball, the ball is placed on the forward 12 and the forward 12 is then permitted to advance two additional spaces along its attacking zone (i.e. dotted line portion). However, if the forward to whom the ball is passed is blocked by a defender, that forward cannot advance upon receiving the pass. Likewise, if the defender is one space back from the forward receiving the ball, the forward can only advance one space after the pass.

Once the attacking player selects the option of either advancing the forward with the ball one space or passing the ball to the forward 12 and then advancing that forward two spaces, the attacking player's turn is completed. It will be assumed herein that the attacking player has passed the ball to the player 12, and advanced that forward two spaces along its attacking zone. The position of the attacking player's pieces at the end of the attacking player's first turn is shown in FIG. 3.

The defending player now moves by positioning his four defenders on any of the spaces 50, 52 in the opposing player's attacking zones. Unlike the forwards, the defenders may be moved from one line of attack 46 to another, although it is a preferred rule of play that a defender may not be moved from one line of attack 46 to another on consecutive turns. Another restriction in the movement of defenders is that once a defender is placed on a space 50 at the end of a line of attack 46, it may not thereafter be moved until the ball has been kicked to the goal or a play period ends. The significance of this rule will become apparent hereinafter.

Figure 4:
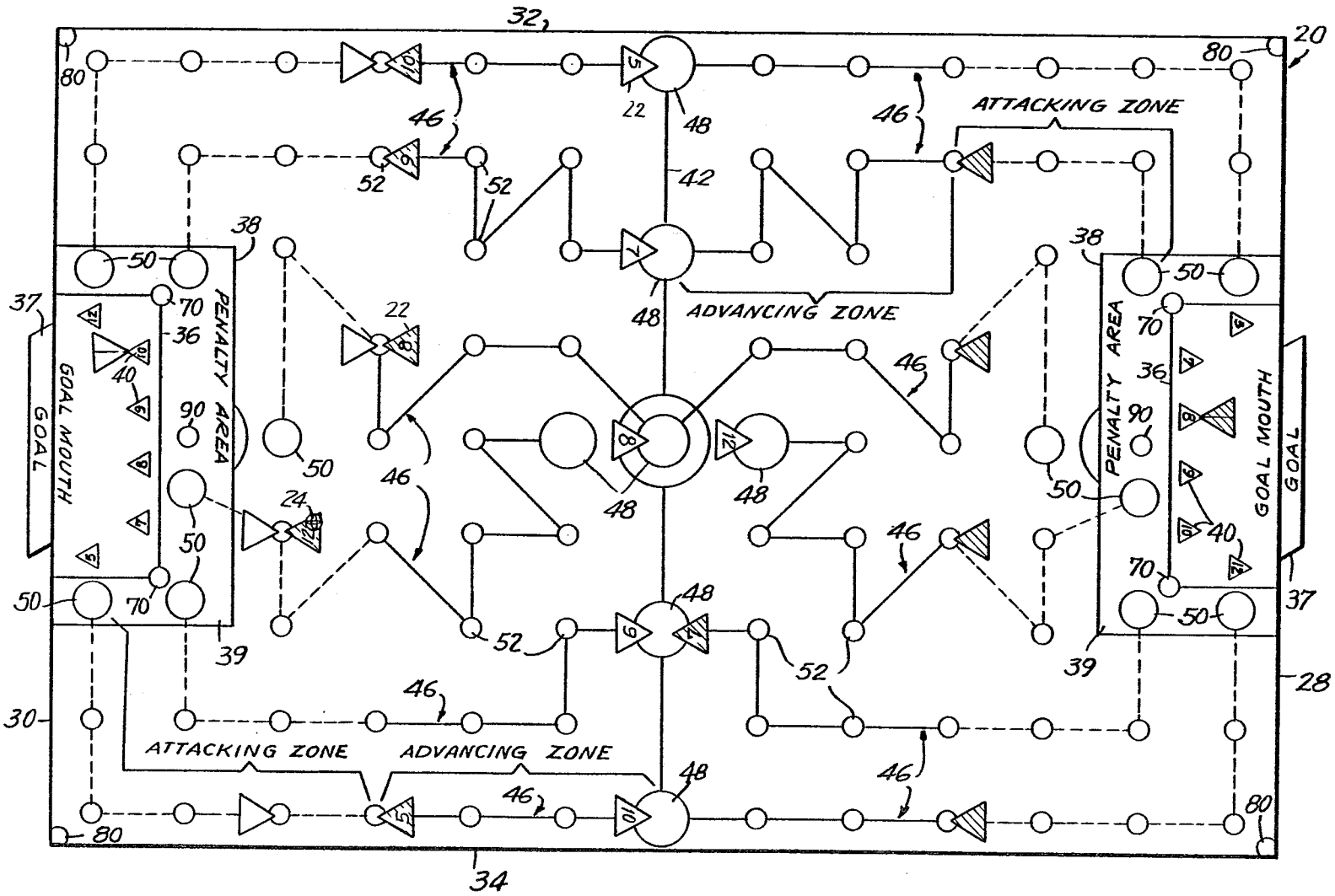

In the example given, the defending player may chose to reposition his defenders as shown in FIG. 4. Once this is done, the defender then rolls his die. If the number indicated on the die is other than that of the forward carrying the ball 24, the defender's turn ends, and the attacking player's next turn begins. However, if the defender rolls the number of the forward carrying the ball, in this case the forward bearing the number 12, one of two things occur. If, in the example given, the defending player has a defender blocking the advance of the attacking forward with the ball, the defender "takes the ball away"0 from the attacking forward and places it on the confronting defender, and the defending player now goes on the attack. The method of commencing an attack from this position will be explained in greater detail below. If the number indicated on the die rolled by the defending player corresponds to the number of the forward carrying the ball 24, but the defending player does not have a defender blocking the advance of the forward with the ball, the defender has "cleared the ball", in which case the ball is taken away from the forward and placed on the midline 42. In this situation, the attacking player does not lose possession of the ball. Rather, the attacking player moves one of his defenders to the midline 42, places the ball 24 on that defender, and recommences his attack. The manner of recommencing an attack from this point will also be explained below.

Returning to the example given, and assuming that the defending player has rolled the die, but that the number does not correspond to the number of the forward carrying the ball 24, the defending player's turn ends, and the attacking player begins his second turn. The position of the pieces before the beginning of the attacking player's second turn is shown in FIG. 4. Before rolling his die on the second turn, the attacking player is again permitted to move any of his forwards which are not carrying the ball as many spaces as he wishes along the advancing portion (i.e. solid line portion) of its corresponding line of attack 46. Referring to FIG. 4, the only attacking forward which has not been advanced to the end of its advancing zone is the forward bearing the number 7. Accordingly, it is only this forward which may be moved to the end of its advancing zone to the position illustrated in FIG. 5. The forwards in their respective attacking zones that are not carrying the ball and are not blocked by defenders may be moved one space further. Thus, unlike the advancing zone, wherein the attacking player may move the corresponding forward as many spaces as he wishes before he rolls his die, once a forward is in its attacking zone, it may only be moved one space at a time before the attacking player rolls his die, provided, of course, that the forward is not blocked by a confronting defender. In FIG. 4, the only forwards without the ball which are in the attacking zone and are not blocked by defenders are the forwards 5 and 10. Accordingly, these forwards may be moved one space further along their corresponding attacking zones before the attacking player rolls his die. Thus, the forwards 5 and 10 may be moved to the positions shown in FIG. 5. At this point, the attacking player rolls his die. Assuming that he does not roll the same number as the forward carrying the ball, i.e. the number 12, the attacking player again has two options. He may either pass the ball to the forward bearing the number indicated on the die, or he may advance the forward with the ball, i.e. the forward 12, one space further along the attacking zone. This latter move is of some interest, since, as noted above, the attacking player can generally not move a forward past a space occupied by a defender. However, an exception to this rule occurs when the defending player, on the previous turn, has placed a defender to block the advance of the forward carrying the ball. This is what took place in the example given. In such instance, the attacking player is permitted to move the advancing player with the ball around the defender. This move, therefore, establishes one element of strategy of the game. Thus, it may be preferable for the defending player, on his turn, to place a defender one space back from the space occupied by the forward advancing with the soccer ball, instead of placing it on the same space as that occupied by the attacking forward. Then, if the attacking player, on his next turn, moves the attacking forward with the ball one space forward to a confronting position with that defender, the attacking player will not, on the successive turn, be able to move around that defender. Thus, and as noted, it is only when a defender has been moved to the space occupied by the attacking forward with the ball that the forward is permitted to move around the defender on the next turn. Of course, if this element of strategy is adopted and the defender is placed one space back from the forward with the ball, the defender is not considered to be blocking the forward and therefore will not be permitted to take the ball away from the forward if the number rolled by the defending player corresponds to the number of the forward carrying the ball 24. Instead, the defending player will only have cleared the ball. This rule permitting the forward with the ball to move around a defender preferably only applies to the forward with the ball, and thus may not be relied upon to move a forward without the ball around a blocking defender.

Figure 5:
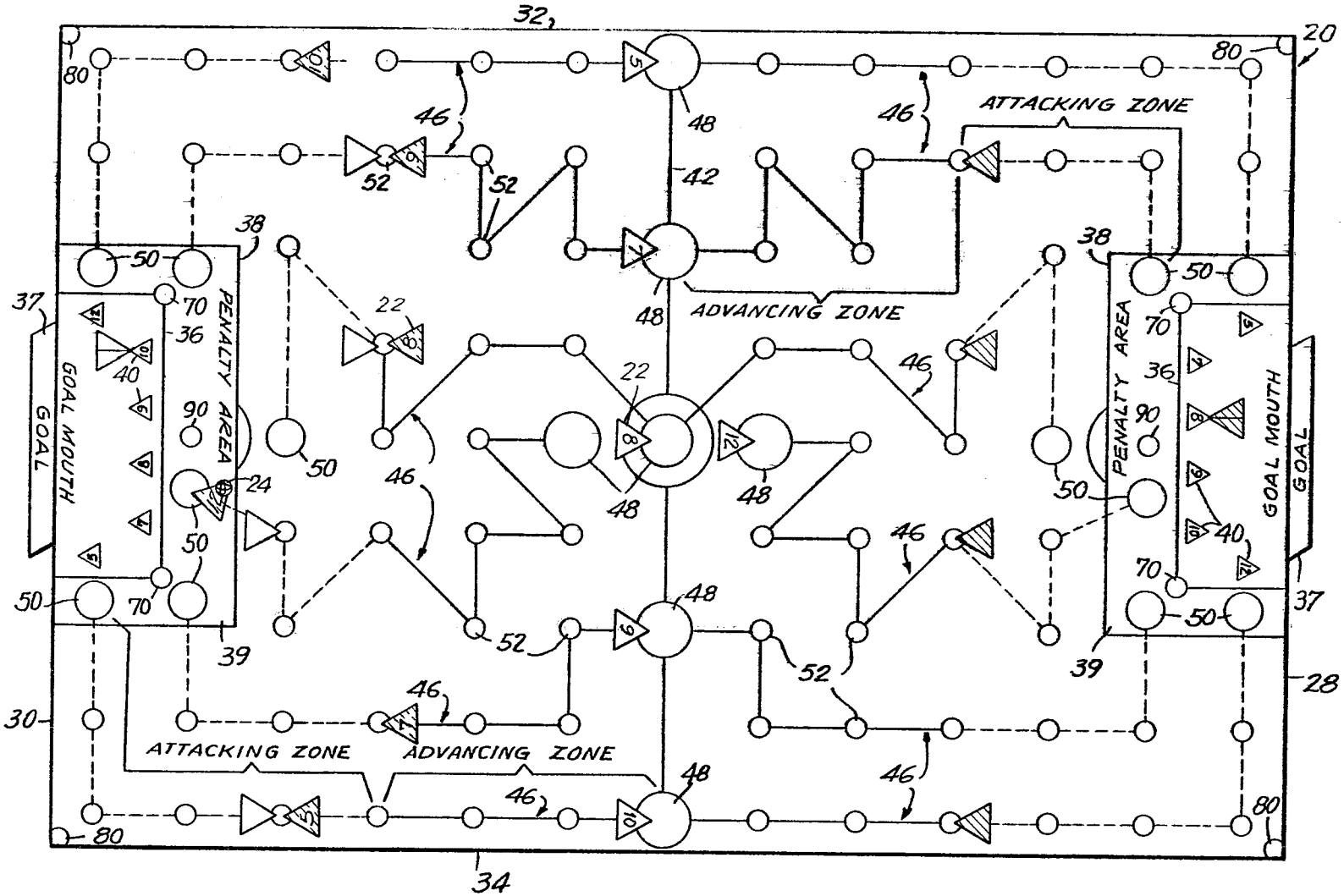

Returning to the example given, assuming the attacking player has rolled the number 10, he may either pass the ball from the forward 12 to the forward 10, or he may advance the forward 12 one space around the confronting defender. If the ball were passed to the forward 10, the forward 10 could not be advanced, since it is blocked by a defender. Therefore, it will be assumed that the attacking player has selected the option of advancing the attacking forward 12 carrying the ball 24. The position of the attacking player's pieces at the end of the attacking player's second turn is shown in FIG. 5.

Figure 6:
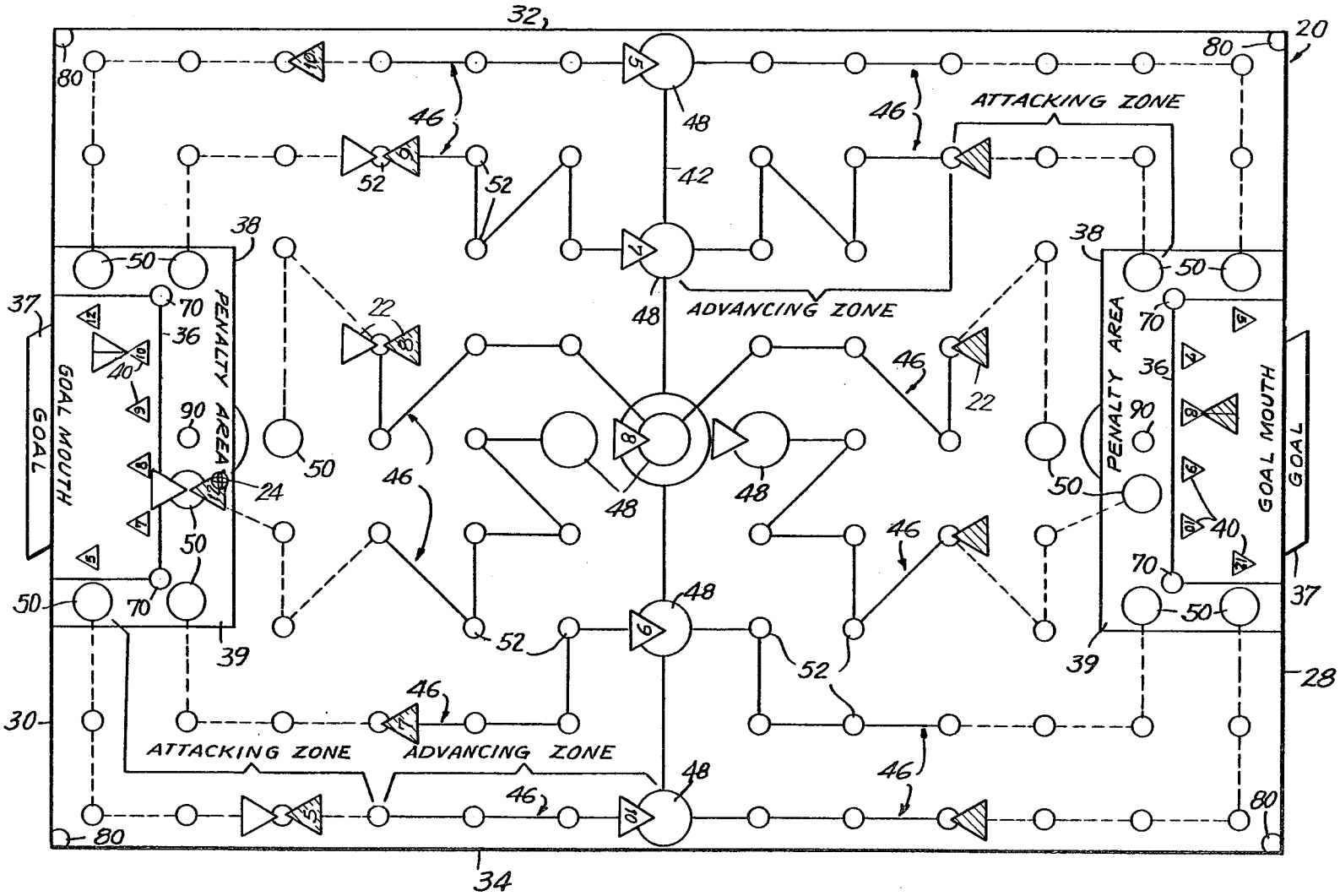

It is now the defender's second turn. Again, the defender is permitted to reposition his four defenders on the spaces 50, 52 in the opposing player's attacking zones in an effort to block the advance of the soccer ball toward the goal. However, and as noted, it is a preferred rule of the game that no defender may be moved from one line of attack 46 to another on two consecutive turns. However, a defender may be moved to different positions along a single line of attack on two consecutive turns. Thus, in the example given, the defending player is permitted to reposition the defender which has now been passed by the attacking forward 12 back into a blocking position in front of that forward, even though that defender was moved onto that line of attack 46 on the previous turn. It is also permissible for the defending player, on his turn, to place his goalie on one of the spaces 50. However, this is generally risky since, like the defenders, once a goalie is moved to a space 50 it may not thereafter be moved until the attacking player has kicked the ball to the goal or a play period ends. Returning to the example, it is assumed that the defending player has repositioned his defenders as shown in FIG. 6.

Once the defending player has positioned his defenders according to his wishes, he rolls his die. Again, if the number indicated on the die does not correspond to the number on the forward carrying the ball, the defending player's turn ends, and the attacking player's third turn begins. If, on the other hand, the number indicated on the die rolled by the defending player corresponds to the number of the forward carrying the ball, the defending player has then either "cleared the ball" or "taken the ball away", depending upon whether or not the defending player has a defender in a blocking position relative to the forward advancing with the ball. In the example given, it will be assumed that the defending player has again failed to roll the number corresponding to the forward carrying the ball and, therefore, that the attacking player's third turn begins.

Play continues with the players alternating turns in the manner described above. Thus, on each turn, before he rolls his die, the attacking player is permitted to move each unblocked forward one space further along its corresponding attacking zone, provided that forward is not blocked by a defender. After the attacking player rolls his die, he is then permitted to either pass the ball to the attacking forward whose number is indicated on the die, or to advance the forward with the ball one space, except where the attacking forward with the ball is blocked by a defender who was not moved to that space on the preceding turn. The defending player, on each turn, is permitted, before he rolls his die, to position his defenders on any one of the spaces in the opposing player's attacking zones, except that he may not move the same defender from one line of attack to another on two consecutive turns. After positioning his pieces, the defender rolls his die. If he rolls a number corresponding to the number of the forward carrying the ball 24, the defender either "clears the ball" or "takes the ball away", depending upon whether or not the defending player has a defender blocking the forward carrying the ball. If the number rolled by the defending player does not correspond to that of the forward carrying the ball, the defending player's turn ends.

Figure 7:
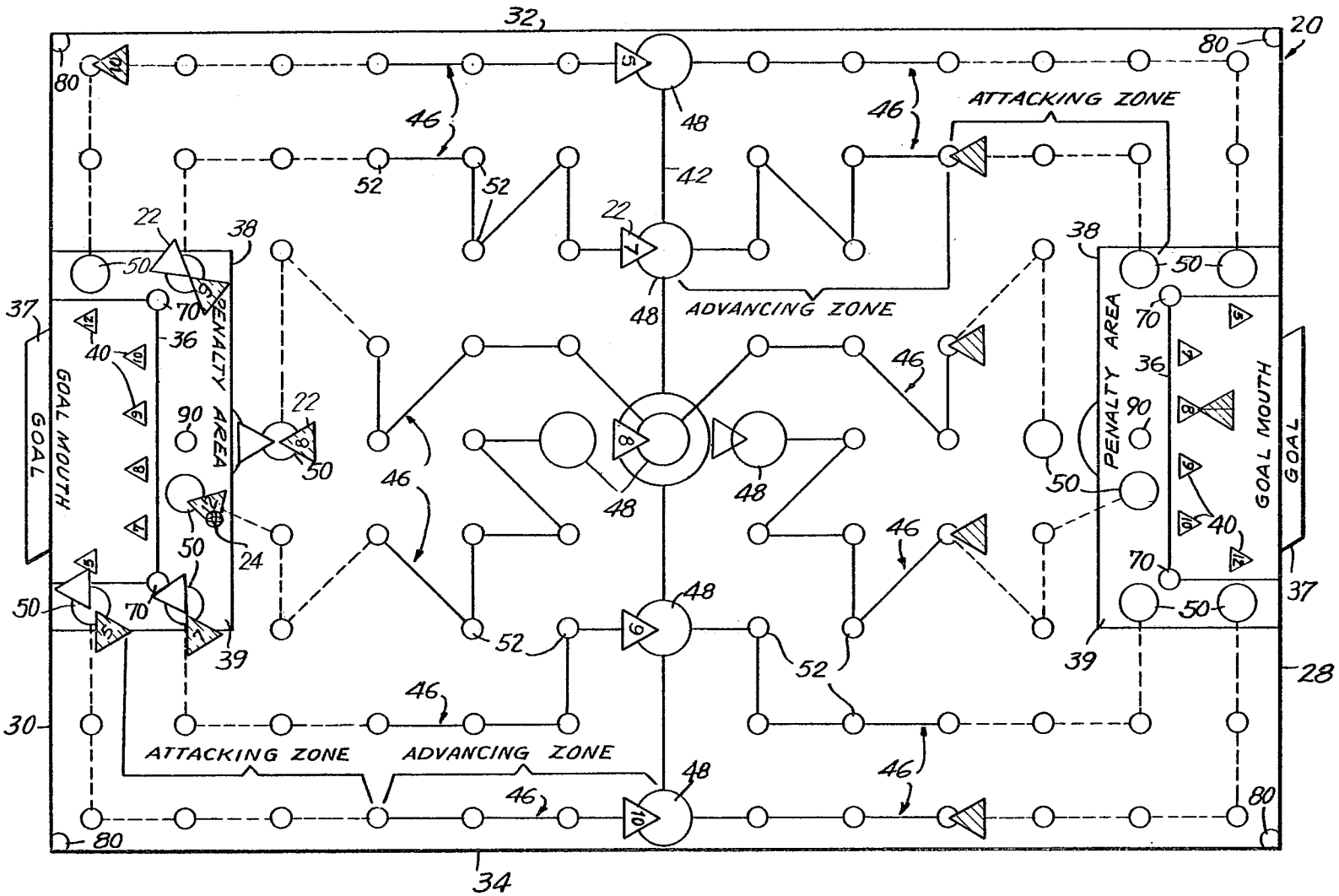

Assuming the attacking player does not lose the ball, he continues advancing the ball in the manner described above until he is able to position an unblocked forward in possession of the ball on the space 50 at the end of its corresponding attacking zone. When the attacking player has reached this position, he is ready to "kick the ball to the goal". A typical position of the playing pieces 22 before the attacking player kicks the ball to the goal is shown in FIG. 7. In FIG. 7, the attacking player has five forwards on the spaces 50. The four forwards without the ball are blocked by defenders. The fifth forward, the forward bearing the number 12, is carrying the ball and is unblocked by a defender. Assuming it is the attacking player's turn, the forward 12 may kick the ball to the goal. To do so, the attacking player rolls his die. However, before doing so, the defending player may reposition his goalie on any one of the spaces 40 in the goal mouth. After doing so, the attacking player rolls his die and places the soccer ball 24 on the space 40 in the goal mouth which corresponds to the number indicated on the die. If the attacking player rolls either the number 5 or the number 12, the ball is considered to have gone out of bounds over the goal line. The method of continuing play at this point will be explained below. If the number indicated on the die corresponds to the space 40 occupied by the goalie, the goalie has caught the ball and successfully defended the goal. The manner of continuing play from this position is also described below. If the number indicated on the die corresponds to one of the three other spaces 40, i.e. the spaces 40 bearing the indicia 7, 8 or 10, the ball is placed on that space. From this position, the defending player has one last opportunity to defend his goal. To do so, he rolls his die, and if he rolls the number corresponding to the space upon which the ball has been placed, the goalie has caught the ball and successfully defended the goal. If, however, any other number is rolled, the attacking player has scored a goal. It is a preferred rule of the game that when an unblocked forward in possession of the ball is in a position to kick the ball to the goal, i.e. on an unblocked space 50, the attacking player must kick the ball to the goal. He may not pass it to another player.

Assuming that a goal has been scored, the players again position their pieces as they did at the beginning of the game. Play is then commenced in the manner described above, except that the players do not flip a coin to determine who will attack. Rather, the player who was scored against automatically becomes the attacking player.

Figure 8:
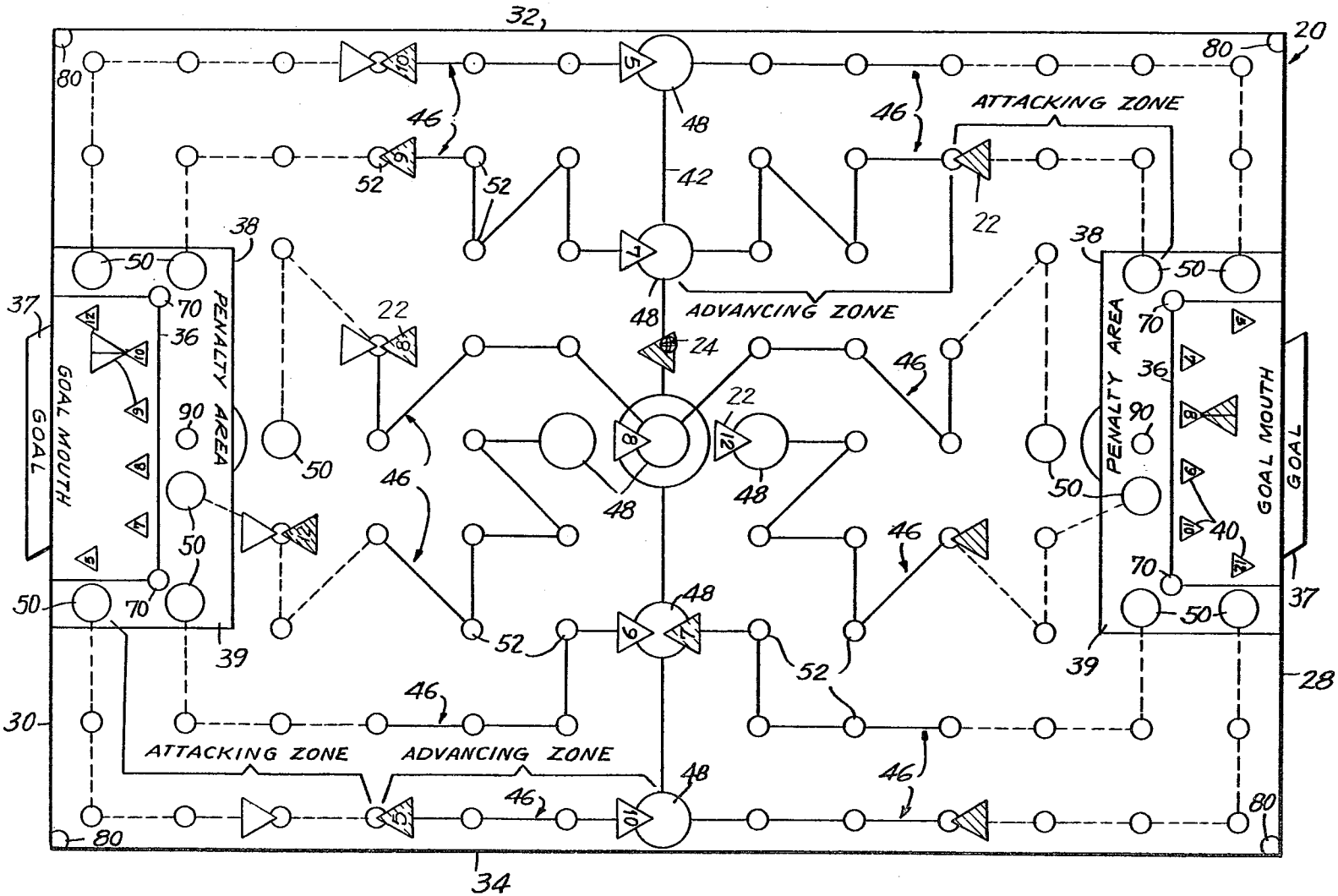

As noted above, there are two principal plays by which the defending player interrupts the attack of his opponent. They are, "clearing the ball" and "taking the ball away". As described more fully above, clearing the ball occurs when the indicia indicated on the die rolled by the defender corresponds to the forward carrying the ball, but the defending player does not have a defender blocking the forward with the ball. For example, this position would occur if, in FIG. 4, the forward 5 has the ball and the defending player rolled the number 5. When this occurs, the attacking player does not lose the ball. Rather, he places the ball on one of his defenders, which is then moved to the center line 42. This is shown in FIG. 8. The attacking player then starts attacking again from that point. That is, he advances his forwards in the manner more fully described above, and then rolls his die. The only difference is that when the attacking player rolls his die in this position, he does not have the option of advancing the forward with the ball, since the ball is now in the possession of a defender. Instead, he can only pass the ball. Assuming the ball is passed to an unblocked forward, that forward is permitted to move two spaces further along its attacking zone in the usual manner. The defender brought to the center line 42 is then returned to its original position, whereupon play continues in the normal manner with the players alternating turns.

The defender "takes the ball away" from the attacker when the number indicated on the die rolled by the defending player corresponds to the attacking forward carrying the ball and the defending player has a defender blocking that forward. This would occur, for example, if the defending player rolled the number 12 with the pieces positioned as shown in FIG. 4. When this occurs, the ball is transferred from the attacking forward with the ball to the blocking defender. The defending player then becomes the attacking player and commences play in the same manner as the attacking player would in a "clear the ball" situation. Thus, the player who took the ball away moves his forwards in the manner permitted, and then rolls his die whereupon the ball is passed to the forward whose number is indicated. The other player, who now becomes the defender, then repositions his defenders in the attacking player's attacking zones and then rolls his die in an effort to clear the ball or take the ball away. Play is then continued with the players alternating turns in the manner described above. It will therefore be apparent that the ball may change hands several times before a player scores a goal, much in the manner of the actual game of soccer. When the ball changes hands, the player who lost the ball does not reposition his forwards. This only occurs when the ball is kicked to the goal or at the end of a play period.

As noted, when the attacking player rolls the die to kick the ball to the goal, and a 5 or a 12 is rolled, the ball is "kicked out of bounds". When this occurs, the defending player takes possession of the ball and begins an attack. As in the actual game of soccer, the defender places the soccer ball 24 on the nearest "goal kick spot" 70 (see FIG. 1), and then commences an attack by first moving his forwards in the manner described above and then rolling his die. As in the case of "taking the ball away", when an attack is commenced in this fashion, the attacking player does not have the option of advancing the forward with the ball on the first move of the attack, as the ball is not yet in the possession of a forward. Accordingly, the first play of such an attack must be a pass. After the first attack play is completed, play is then continued in the usual manner.

When the attacking player kicks the ball to the goal and the goalie catches the ball, the same situation occurs, i.e. the defending player becomes the attacking player, places the ball on the nearest goal kick spot 70, and commences an attack. Whenever a ball is kicked to the goal, the player who kicked the ball to the goal returns his forwards to the spaces 52 at the beginning of their respective zones of attack. When that player regains possession of the ball, an attack is commenced from that position.

Play continues for a period of time fixed in advance by the players. For example, two thirty or forty-five minute halves can be played, with the pieces being positioned as shown in FIG. 1 at the beginning of each half. It may be agreed that the player who began by defending in the first half becomes the attacking player at the beginning of the second half. Alternatively, the players may roll the die, flip a coin, etc. to determine who becomes the attacking player at the beginning of each half. Preferably, the players switch sides at the end of each half. The player scoring the most goals at the end of the game is the winner. If the game ends in a tie, the players may agree to play one or more additional periods of predetermined duration.

There are several additional rules of play, which may be considered optional, but which are preferably incorporated in the game to simulate, as nearly as possible, the actual play of soccer. One such set of optional plays is initiated when the number rolled by the attacking player corresponds to the number of the forward in possession of the ball. There are four possible plays resulting from this roll, the specific play depending upon the position of the forward at the time of the roll. If the roll occurs when the ball is in possession of one of the outside forwards, and that forward is on the portion of its line of attack 46 parallel to one or the other of the side lines, 32, 34, the ball is considered to have gone out of bounds over the side line. In this situation, as when the ball goes out of bounds during a kick to the goal, the attacking player losses possession of the ball. The defending player then places the ball on its nearest defender and starts an attack, following the same rules as that used for commencing an attack when the defender has "taken the ball" away from the attacker or when the defender commences an attack after the ball has been kicked out of bounds during a kick to the goal.

In the second situation, the roll occurs when one of the outside forwards is in possession of the ball, and that forward is on the portion of its line of attack 46 parallel to one or the other of the goal lines 28, 30. When this occurs, the ball is considered to have gone out of bounds over the goal line, and the defending player takes possession of the ball and commences an attack. The only difference between this situation and one where the ball goes out of bounds over the side line is that the attack is commenced by placing the ball on the nearest goal kick spot 70, rather than on the nearest defender. It will be appreciated, however, that this difference is without signficance as regards the positioning of the players, and that it is only included so that the manipulation of the playing pieces during the game corresponds, as nearly as possible, to the actual play of soccer. Since the four spaces 52 in the corners of the game board 20 could be considered to be either parallel to the goal line or parallel to the side line, they are arbitrarily, but preferably, considered parallel to the goal line.

In the third situation, the roll occurs when the attacking forward carrying the ball is one of the interior forwards, and that forward is positioned on the space 52 directly behind the corresponding space 50. The attacking forward is then considered to be "off side" and the attacking player loses possession of the ball. The defending player then takes possession of the ball, places it on the nearest goal kick spot 70, and starts an attack from that point in the same manner as when a ball goes out of bounds over the goal line.

In the fourth situation, the roll occurs when the attacking foward with the ball is at any position other than those discussed above. When this occurs, the attacking forward in possession of the ball is considered to have committed "foul play" whereupon the defending player places the ball on his nearest defender and starts an attack from that point in the manner more fully described above. There is no penalty to the attacking player if the roll occurs when the attacking forward with the ball is on one of the "kick to the goal spaces" 50. In that situation, if the forward is not blocked, the ball is kicked to the goal. If the forward is blocked, the attacking player's turn ends.

Figure 9:
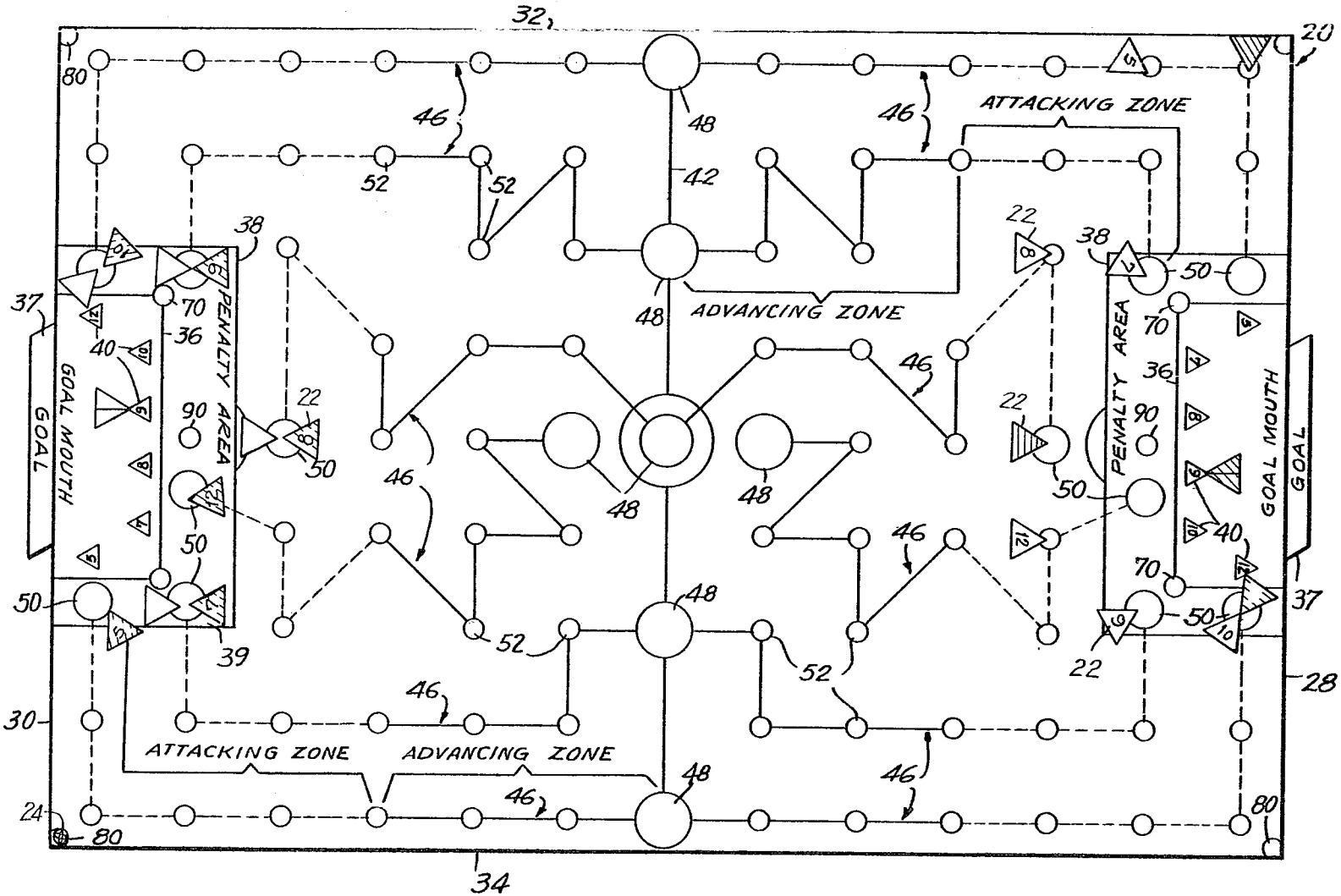

Another optional play preferably incorporated in the game is the "corner kick". This occurs when, after taking the ball away from an outside forward occupying a position parallel to the goal line, the defending player immediately rolls the same number which he previously rolled to take the ball away from the attacker. The player who rolled the die is then considered to have kicked the ball out of bounds over his own goal line. This is sanctioned by a "corner kick". To play the corner kick, the attacking player, i.e. the player who has not kicked the ball out of bounds, places the ball on the nearest corner spot 80 (see FIG. 1), and each forward is moved to its "kick to the goal" position, i.e. the spaces 50. Before the attacking player rolls his die, the defender places his four defenders to block four of the kick to the goal positions 50 and the goalie on one of the spaces 40 in the goal mouth. This position of the playing pieces is shown in FIG. 9. The attacking player then rolls his die, and the ball is placed on the forward indicated by the die. The attacking player then commences play in the normal manner. That is, if the attacking forward carrying the ball is not blocked by a defender, the attacking player kicks the ball to the goal as is more fully described above. However, if the attacking player is blocked by a defender, the attacking player rolls his die and passes the ball to the forward whose number is indicated. It the number rolled corresponds to the forward with the ball, the attacking player's turn simply ends. The defender then takes his turn, and so so, with the play continuing in the usual fashion. Prior to rolling his die, the defending player is not permitted to move his defenders from one "kick to the goal" space 50 to the next, since, as noted above, once the defenders are placed on a kick to the goal space 50, they cannot again be moved until the ball has been kicked to the goal or a play period ends.

Another option preferably incorporated in the game is the "penalty kick". The penalty kick occurs when the defending player, after taking the ball away from the attacking player inside the penalty area, commences an attack by rolling the same number rolled to take the ball away. This is considered to be a form of foul play and is penalized by a penalty kick. To play the penalty kick, all of the soccermen are removed from the penalty area and the soccer ball 24 is placed on the penalty kick spot 90 (see FIG. 1). The attacking player places a forward in front of the soccer ball 24 and the defending player places its goalie on one of the spaces 40 in the goal mouth. The attacking player then rolls its die and kicks the ball to the goal, whereupon the game continues in the usual fashion. That is, if the attacking player rolls the numbers 5 or 12, the ball goes out of bounds and the defending side takes possession and commences an attack. If the attacking side rolls the number occupied by the goalie, the goalie is considered to have caught the ball and the defending player commences an attack. If the attacking side rolls one of the remaining three numbers, the ball is placed on that number and the defending player then has one final chance to block the goal by rolling that number on his next turn. If he does, the defending player takes possession and commences an attack. If he does not, the attacking player has scored a goal. In those instances where the attacking player does not score a goal during a penalty kick, the attacking player's forwards are returned to the spaces 52 at the beginning of their respective attacking zones.

Another optional play preferably incorporated in the game is the "hand ball". This occurs when the number rolled on the die is repeated for the third time. If the player repeating a number for the third time is in possession of the ball, he losses the ball to the other player, who places it on the nearest defender and commences an attack from that point. A hand ball is also considered to have occurred if the same number is rolled a fourth time, fifth time, etc., with the ball changing hands with each such roll until the string of consecutive identical numbers is broken.

Yet another optional play preferably incorporated in the game is the "barrier". This occurs when the defender, after taking possession of the ball on its own side of the board, rolls either the same number used to take the ball away, or rolls the same number for the third consecutive time, provided the ball is outside the penalty area when the roll occurs. In this situation, the attacking player may kick the ball to the goal, even though none of the attacking forwards is in a kick to the goal position, i.e. on a space 50. This is the only situation where the attacking player may kick the ball to the goal from other than one of the kick to the goal positions. The kick to the goal is carried out by moving the attacking forwards along their corresponding lines of attack 46 to their positions nearest the ball, and the ball is placed on the nearest forward. However, before the ball is kicked to the goal, the defender may form a barrier by moving two of his own forwards to the space occupied by the attacking forward with the ball. As usual, the defending player is also permitted to reposition his goalie before the ball is kicked to the goal. At that point, the attacking player rolls his die. If the number rolled corresponds to one of the defender's two forwards, that forward takes possession of the ball. The defending side then becomes the attacker, and moves its two forwards to the spaces they last occupied. The attack is then commenced from that point in the usual manner. If the number rolled by the attacking player does not correspond to one of the two forwards in front of the ball, the game continues as if the ball had been kicked to the goal in the usual manner, and the defending player's two forwards are returned to the spaces they last occupied.

Yet another option preferably incorporated in the game to simulate, as nearly as possible, the actual play of soccer, is the "header ball". This occurs when the attacking player passes the ball to another forward when the receiving forward is in an undefended kick to the goal position 50. If this occurs, the ball may be immediately transferred from the receiving forward to the corresponding space 40 in the goal mouth. Obviously, this will only be done if the number of the forward receiving the pass is other than 5, 12 or the number of the space 40 occupied by the defender's goalie. When this play is used, the defender then has his usual one last chance to block the goal by rolling the number of the space 40 upon which the ball has been placed.

The game has been described on the assumption that two persons will be playing. However, when more than two persons play, two teams are formed, each with an equal number of players. The participants on each team may take turns controlling play each time possession of the ball changes. If there is an odd player, he may act as a referee.

While I have herein shown and described the preferred apparatus and method for playing the game according to the present invention, it will be apparent to those skilled in the art that numerous changes and modifications may be made therein without departing from the spirit and scope of this invention. Accordingly, the above description should be construed as illustrative and not in the limiting sense, the scope of the invention being defined by the following claims.

I claim:

1. A game apparatus for at least two players for simulating the game of soccer, said game apparatus comprising:

first and second equal pluralities of playing pieces representing first and second teams of soccermen, means for distinguishing the first team from the second and for distinguishing, among each team, a plurality of forwards, a lesser plurality of defenders, and a goalie, and means for individually distinguishing the forwards of each team from each other; a game board having indicia delineating (a) first and second goal areas at opposite ends of said board, each goal area having indicia therein corresponding to the means for distinguishing said forwards from each other, and (b) first and second pluralities of player movement paths, there being one path for each forward on each team, each path comprising a plurality of spaces representing positions for said soccermen, each path including a first group of consecutive spaces defining an advancing zone and a second group of consecutive spaces defining an attacking zone, the final space of the attacking zone of each of said first plurality of paths terminating near one goal area and the final space of the attacking zone of each of said second plurality of paths terminating near the other goal area, said defenders being positionable on the spaces in the paths occupied by the opposing team's forwards for blocking the movement of said forwards therealong;

a piece representing a soccerball, said soccerball being movable with said forwards toward said goal areas;

chance means manipulatable by said players, said chance means having indicia thereon corresponding to said means for distinguishing said forwards and to said indicia in said goal areas, said chance means being manipulatable by one player for passing said ball from one of said one player's forwards to said one player's forward having distinguishing means corresponding to the indicia indicated on said chance means, and for moving said ball into said goal area when the forward associated with the ball is on a predetermined space in its corresponding player movement path and the indicia indicated on said chance means corresponds to an unoccupied indicia in said goal area, said chance means being manipulatable by said other player for interrupting movement of said ball by said one player when said indicia indicated on said chance means corresponds to the distinguishing means of said one player's forward associated with the ball.

2. The game apparatus according to claim 1, wherein said first and second equal pluralities of playing pieces comprise eleven playing pieces, wherein said plurality of forwards comprises six forwards, and wherein said plurality of defenders comprises four defenders.

3. The game apparatus according to claim 2, wherein said chance means comprises a die having six faces.

4. The game apparatus according to claim 3, wherein the spaces in said advancing zones are connected by a solid line and the spaces in said attacking zones are connected by a dotted line.

5. The game apparatus according to claim 4, wherein said game board is of rectangular, planar configuration.

* * * * *